US007287816B1

(12) United States Patent
Karl

(10) Patent No.: US 7,287,816 B1
(45) Date of Patent: Oct. 30, 2007

(54) CHAIR AND GROUPING THEREOF

(75) Inventor: Richard B. Karl, St. Charles, IL (US)

(73) Assignee: Norix Group, Inc., West Chicago, IL (US)

( * ) Notice: Subject to any disclaimer, the term of this patent is extended or adjusted under 35 U.S.C. 154(b) by 448 days.

(21) Appl. No.: 10/956,441

(22) Filed: Oct. 1, 2004

(51) Int. Cl.
*A47C 5/12* (2006.01)

(52) U.S. Cl. ..... 297/452.17; 297/452.11; 297/452.59; 297/452.65

(58) Field of Classification Search ..... 297/440.14, 297/452.11, 452.16, 452.17, 452.59, 452.14, 297/452.65
See application file for complete search history.

(56) References Cited

U.S. PATENT DOCUMENTS

| | | | | |
|---|---|---|---|---|
| D132,793 | S | 6/1942 | Reiss | |
| 3,180,681 | A | 4/1965 | Buralli | |
| 3,230,007 | A | 1/1966 | Spangler et al. | |
| 3,574,400 | A | 4/1971 | Day | |
| 3,647,260 | A * | 3/1972 | Grant et al. | 297/229 |
| 3,713,697 | A * | 1/1973 | Koepke | 297/452.61 |
| 3,823,980 | A * | 7/1974 | Harnick | 297/452.14 |
| 3,839,838 | A | 10/1974 | Vigh | |
| D240,311 | S | 6/1976 | Owens | |
| 4,018,479 | A * | 4/1977 | Ball | 297/452.19 |
| 4,077,665 | A * | 3/1978 | Storch | 297/244 |
| 4,077,666 | A * | 3/1978 | Heumann | 297/440.14 |
| 4,092,049 | A | 5/1978 | Schoblom | |
| D248,802 | S | 8/1978 | Iselin | |
| D255,959 | S | 7/1980 | Mitchell | |
| D273,156 | S | 3/1984 | Dubbin et al. | |
| D284,142 | S | 6/1986 | Raftery | |
| D286,586 | S | 11/1986 | Radford | |
| 4,717,202 | A | 1/1988 | Batchelder, III et al. | |
| 4,836,609 | A * | 6/1989 | Hill | 297/452.55 |
| D364,749 | S | 12/1995 | McKnight | |
| D366,966 | S | 2/1996 | Bonaddio et al. | |
| 5,522,645 | A * | 6/1996 | Dahlbacka | 297/452.55 |
| D372,367 | S | 8/1996 | Bonaddio et al. | |
| D418,313 | S | 1/2000 | Sexton et al. | |
| D418,326 | S | 1/2000 | Sexton et al. | |
| D418,987 | S | 1/2000 | Panton | |
| D435,978 | S | 1/2001 | Pluer | |
| D443,769 | S | 6/2001 | Tiffany, III et al. | |
| D460,283 | S | 7/2002 | Floyd, Jr. | |
| 6,543,845 | B2 * | 4/2003 | Seitz et al. | 297/248 |
| 6,640,354 | B2 | 11/2003 | Bonack et al. | |

* cited by examiner

*Primary Examiner*—Peter R. Brown
(74) *Attorney, Agent, or Firm*—Mathew R. P. Perrone, Jr.

(57) ABSTRACT

A chair has a durable surface with top cover supported by foam thereby providing an ergonomic recoverable shape and a fluid directing perimeter rim or perimeter ridge on a bottom surface thereof.

14 Claims, 3 Drawing Sheets

CHAIR AND GROUPING THEREOF

This invention relates to a chair and more particularly to a chair, which avoids or minimizes a chance for a fluid spilled on or adjacent to a chair from getting under or into the chair and provides a device and method of grouping the chairs.

BACKGROUND OF THE INVENTION

While it is always desirable and furniture be aesthetically pleasing, additional benefits are obtained if the furniture is durable and adaptable. Such benefits are discussed in U.S. Pat. No. 5,496,091; of which the inventor herein is a co-inventor thereof. This patent is incorporated herein by reference.

The ergonomics, aesthetics and utility are additional advantages obtained when durable furniture has such features. Such factors are discussed in the referenced patent and need not be repeated here.

With such public use of the furniture, a spill of fluid is very likely. It is very desirable for such a spill of fluid to be cleaned or removed. The problem of such cleaning is greatly complicated, if the fluid migrates under the chair. If such a migration of fluid can be minimized, or avoided, great advantages can be obtained.

Complications of a cleanup also occur when fluid flows into a crevasse or an indentation in the chair. Such a crevasse or an indentation is inherently hard to reach or access, and hence inherently difficult to clean. Yet such indentations or crevasses are necessary to achieve a comfortable chair.

With the durable surface of the chair, prevention of such a flow of fluid is extremely difficult. The sloping of the chair surfaces contributes to the great possibility of the fluid spilled on the chair flowing to a point under that chair.

When chairs are grouped, any spill of fluid has a more complicated cleaning procedure. Complications are even further aggravated, if the spilled fluid migrates under the groups of chairs. It is clearly more difficult to move a group of chairs than it is to move one chair, because of the inherent increase in bulk or weight. This is especially true when each member of the group of chairs is secured to another member of the group of chairs.

It is very desirable, for the group of chairs to be joined together without compromising the prevention of the flow of spilled fluid, to a position situated under one or more of the chairs. Such a joining mechanism, to be effective, must be secure and at least substantially not interfere with the desired direction of fluid away from a position underneath the chair.

SUMMARY OF THE INVENTION

Among the many objectives of this invention is the provision of a chair having a fluid directing perimtere rim.

Another objective of this invention is the provision of a chair which may be grouped with at least one other chair.

Yet another objective of this invention is the provision of a chair, which minimizes a flow of a fluid spilled thereon to a point thereunder.

Still, another objective of this invention is the provision of an aesthetically pleasing chair.

Additionally, an objective of this invention is the provision of a durable chair.

A further objective of this invention is the provision of a chair which lacks a surface indentation which is hard to access.

A still further another objective of this invention is the provision of a chair, which lacks a surface crevasse which is hard to access.

These and other objectives of the invention (which other objectives become clear by consideration of the specification, claims and drawings as a whole) are met by providing a chair having a durable surface with an ergonomic recoverable shape and a fluid directing perimeter rim or perimeter ridge on a bottom surface thereof.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
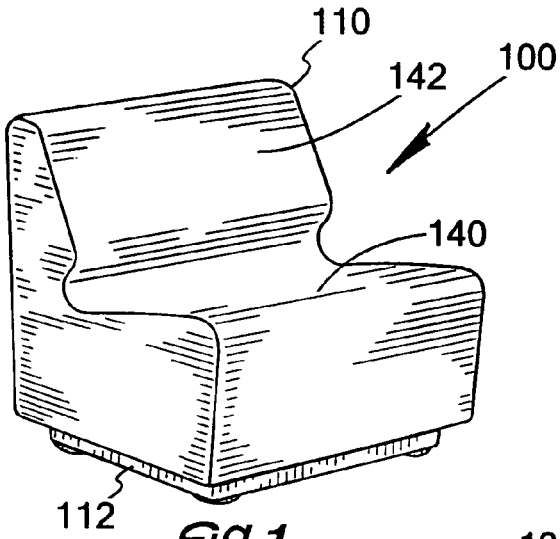
FIG. 1 depicts a front, top perspective view of chair 100 of this invention.
Figure 2:
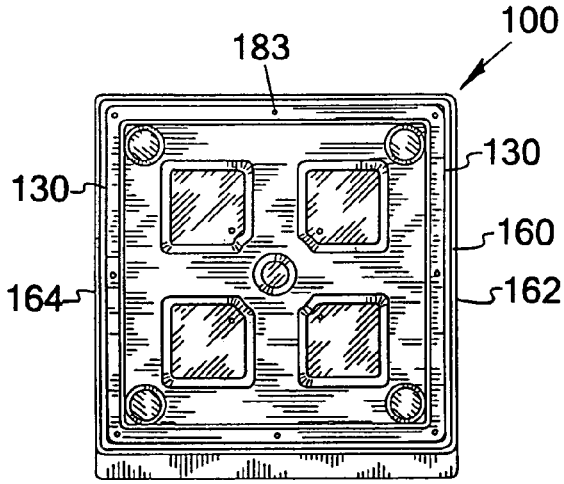
FIG. 2 depicts a bottom plan view of chair 100 of this invention.
Figure 3:
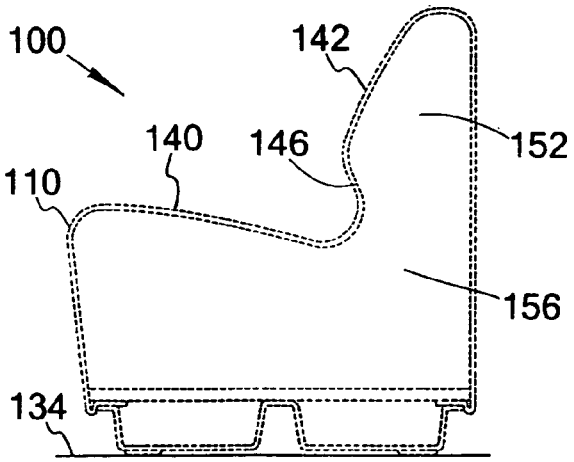
FIG. 3 depicts a side view of chair 100 of this invention.
Figure 4:
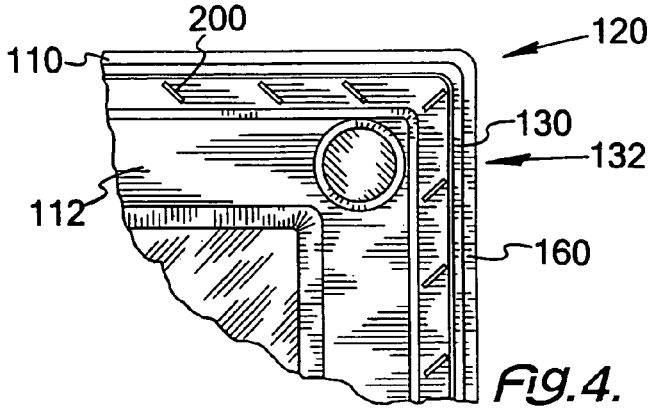
FIG. 4 depicts a bottom plan view of chair 100 of this invention from corner 120.

For the chair of this invention, a top cover is secured to a bottom panel. Over the bottom panel is secured a support panel. Between the support panel and within the top cover is a foam support. While the top cover and the bottom panel may also be molded as one unit, preferably, the top cover, the support panel and the bottom panel are fabricated and assembled. The components may be secured by gluing, stapling, screws or other appropriate fastening devices.

Within the top cover is a seating portion and a back portion. The back portion and the seating portion flow together with what is substantially an S-curve, when viewed from the side of the chair. While it is not desired to be bound by any particular theory, it is postulated that the durable surface with the S-curve supported by the foam within the top cover combine to form an easily cleanable, comfortable, ergonomically acceptable chair. The chair is shaped to provide for a fluid flow off of the chair and away from an underside of the chair or group of the chairs.

Within the chair is a foam material having a density of about 10 grams to about 50 grams per cubic centimeter. More preferably, the foam material has a density of about 15 grams to about 45 grams per cubic centimeter. Most preferably, the foam material has a density of about 25 grams to about 35 grams per cubic centimeter (about 1.8 pounds to about 3.2 pounds per cubic foot).

The foam supports the outer skin or top cover from the inside and fills the space between the bottom panel and the top cover. Any flexible foamed material of the desired density may be used in the share. Typical, examples thereof are foamed polyurethane, foamed polyimide, and mixtures thereof. Most preferred is the foamed polyurethane of the desired density.

The bottom panel is substantially centrally located in the bottom portion of the top cover. Around the edge of the bottom portion of the top cover is a perimeter rim. As a fluid is spilled on the chair, it will flow down the sides of the chair and contact the perimeter rim. With that contact, the fluid is directed away from the chair.

One chair may be joined ganged or group with another, by using a plate to one bottom panel to another and sequencing that action in order to join as many chairs as desired. Bottom panel is molded or otherwise shaped to form raised portions therein. Thus, as the raised portions extend from the bottom of the chair, and contact the floor. The raised portions thus form a surface substantially perpendicular to the floor. A ganging plate joins the adjacent surfaces of those raised portions by screws or other fastening devices.

Referring now to FIG. 1, FIG. 2, FIG. 3, and FIG. 4, chair 100 has top cover 110 communicating with bottom panel 112. At corner 120, liquid perimeter rim 130 may be seen on bottom segment 132 of top cover 110. Bottom panel 112 is molded or otherwise shaped into a desired pattern, in order to provide a raised portion and separate top cover 110, from a floor surface 134.

Liquid perimeter rim 130 may be formed in bottom segment 132 of top cover 110. Bottom panel 112 may also be molded or otherwise shaped into a desired form to form liquid perimeter rim 130. Combinations thereof may also form liquid perimeter rim 130 from bottom segment 132 of top cover 110 or bottom panel 112.

Shown on the top cover 110 is a seating portion 140 and a back portion 142. The back portion 142 and the seating portion 140 flow together at front portion of top cover 110 with what is substantially a modified S-curve 146, when viewed from the side of chair 100, formed from the cooperation of the foamed polymer 192 with the top cover 110.

Assuming for the sake of argument, that back portion 142 has a back tangential plane 152 (shown in phantom) and that seating portion 140 has a seating tangential plane 154 (shown in phantom), there is a plane intersection 156 thereof. Plane intersection 156 has an angle preferably in the range of about 70 degrees to about 120 degrees. More preferably the angle is about 75 degrees to about 115 degrees. Most preferably the angle is about 80 degrees to about 110 degrees.

With liquid perimeter rim 130, any fluids spilled on chair 100 do not flow under the chair. For molding convenience, liquid perimeter rim 130 extends completely around a lower edge 160 of top cover 110. It is also possible to have perimeter rim 130 extend only along first side 162 and second side 164.

Figure 5:
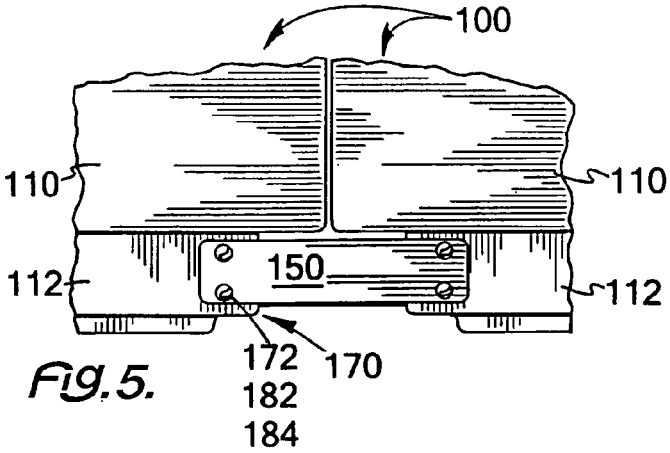
FIG. 5 depicts a close-up view of ganging plate 150 for chair 100 of this invention.
Figure 6:
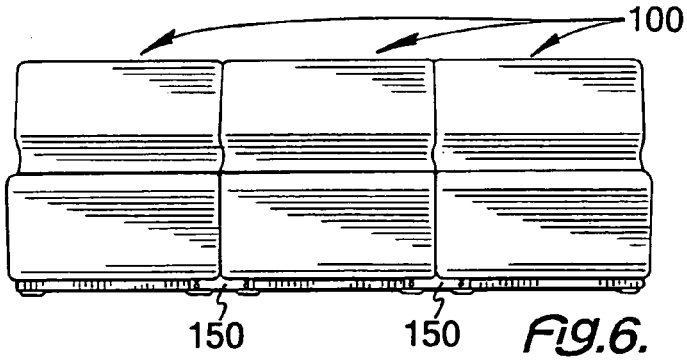
FIG. 6 depicts a front plant view of three of chair 100 of this invention joined with ganging plate 150.

With the additional consideration of FIG. 5 and FIG. 6, the ganging feature can be shown. More particular, adjacent to lower corner 170, of bottom panel 112 are ganging apertures 172 in front surface 174 of bottom panel 112. Two of chair 100 are placed adjacent to each other.

A ganging plate 180, with plate apertures 182 therein, are placed on two of bottom panel 112, so that each plate aperture 182 aligns with a corresponding ganging aperture 172. Then a screw 183 is placed through each pair of apertures thereby joining a first chair 100 to a second chair 100. In this fashion, the first chair 100 and the second chair 100 are joined together.

Screw 183 may be any suitable fastener. Preferably, the screw 183, is of irremovable or non-reversible type. Such a restrictive screw is especially important when the particular chair 100 or ganging thereof is used in an incarceration facility. Top cover 110 combines with bottom panel 112 and ganging plate 150 to render the chair 100 difficult, if not impossible, to conceal prison contraband.

Figure 7:
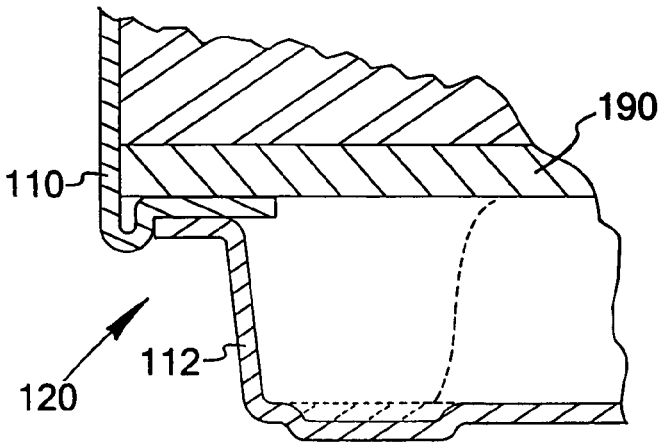
FIG. 7 depicts a side, cross-sectional view of chair 100 of this invention from corner 120, based on FIG. 4.
Figure 8:
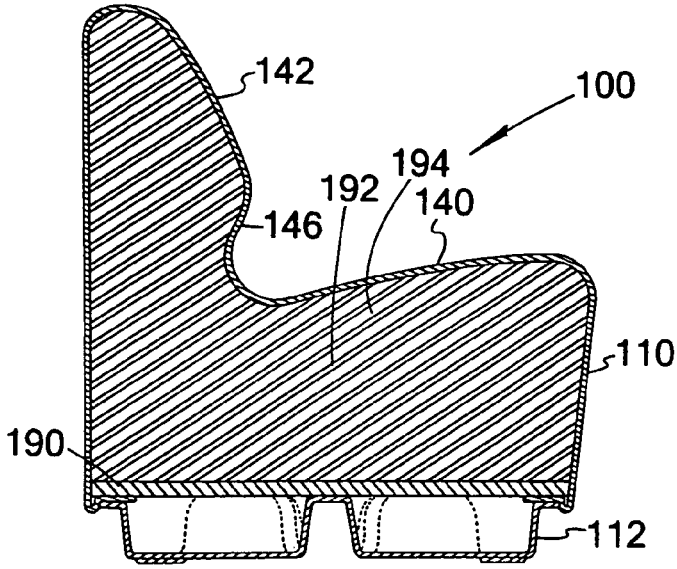
FIG. 8 depicts a side cross-sectional view of chair 100.

Adding FIG. 7 and FIG. 8 the structure of chair 100 becomes even more clear. Over bottom panel 112 is placed a support panel 190. Support panel 190 preferably substantially covers bottom panel 112 and is very rigid. Suitable materials for support panel 190 include, but are not limited to, plywood, particle board, and plastic sheets.

Support panel 190 has a thickness of up to about 5 centimeters. More preferably, support panel 190 has a thickness of about one to about 5 centimeters. Most preferably, support panel 190 has a thickness of about 1.5 to about 2.5 centimeters.

A foamed polymer 192 fills the cavity 194 formed in the chair 100 between the top cover 110 and bottom panel 112. In a preferred form, support panel 190 separates the foamed polymer 192 from the bottom panel 112. The density of the foamed polymer 192 cooperates with the support panel 190 and the bottomed out 112 to hold a cover 110 in the desired shape. Thus, seating portion 140 is connected to back portion 142 with modified S-curve 146, in order to form an ergonomically comfortable chair 100.

Staples 200 and screws 183 efficiently secure the parts of chair 100 together. Preferably, top cover 110 is a flexible vinyl fabric which adds strength and durability to chair 100, while providing comfort.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A chair having a durable surface with an ergonomic recoverable shape comprising:

(a) the chair having a top cover is secured to a bottom panel;

(b) the bottom panel having a support panel secured thereover;

(c) a foam support being situated between the support panel and the top cover;

(d) the foam support being situated within the top cover;

(e) the top cover being shaped by the foam support to direct a fluid flow away from a surface of the chair;

(f) the chair including a directing means to keep the fluid from passing under the chair;

(g) the directing means including a fluid directing perimeter rim on a lower surface of the chair said rim extending below the support panel and having an upwardly turned U-shaped section that is secured to the support panel;

(h) the top cover providing a seating portion and a back portion for the chair;

(i) the foam support shaping the back portion and the seating portion of the chair;

(j) the top cover communicating with the bottom panel;

(k) the back portion having a back tangential plane;

(l) the seating portion having a seating tangential plane;

(m) the back tangential plane and the seating portion having a plane intersection; and (n) the plane intersection having an angle in a range of about 70 degrees to about 120 degrees.

2. The chair of claim 1 further comprising:

(a) the top cover having a bottom cover perimeter;

(b) the bottom panel having a bottom panel perimeter; and (c) the fluid directing perimeter rim being at or adjacent to the bottom cover perimeter and the bottom panel perimeter.

3. The chair of claim 2 further comprising:

(a) an S-curve in a portion of the top cover connecting the back portion and the seating portion of the chair; and (b) the chair foam support having a density of about 10 grams to about 50 grams per cubic centimeter.

4. The chair of claim 3 further comprising the chair foam support having a density of about 15 grams to about 45 grams per cubic centimeter.

5. The chair of claim 4 further comprising the chair foam support having a density of about 25 grams to about 35 grams per cubic centimeter.

6. The chair of claim 5 further comprising:

(a) the foamed polymer supporting the top cover from the inside and filling the space between the bottom panel and the top cover; and (b) the foamed polymer being at least one polymer selected from the group consisting of foamed polyurethane, and foamed polyimide.

7. The chair of claim 4 further comprising:

(a) the foamed polymer supporting the top cover from the inside and filling the space between the bottom panel and the top cover; and (b) the foamed polymer being at least one polymer selected from the group consisting of foamed polyurethane, and foamed polyimide.

8. The chair of claim 3 further comprising:

(a) the foamed polymer supporting the top cover from the inside and filling the space between the bottom panel and the top cover; and (b) the foamed polymer being at least one polymer selected from the group consisting of foamed polyurethane, and foamed polyimide.

9. The chair of claim 3 further comprising:

(a) the bottom panel being substantially centrally located in a bottom portion of the top cover;

(b) the bottom portion of the top cover having the fluid directing perimeter rim in order for a fluid on the chair to flow down the chair and contact the fluid directing perimeter rim so that the fluid is directed away from an under portion of the chair.

10. The chair of claim 9 further comprising:

(a) the bottom panel being shaped to form raised portions;

(b) the raised portions extending from a bottom of the chair, and contacting a floor;

(c) the raised portions forming at least one surface substantially perpendicular to the floor;

(d) the at least one surface being two adjacent surfaces being on a separate member of the chair;

(e) a plate joining the two adjacent surfaces in order to secure two of the chair together; and (f) at least two fastening devices securing the plate to the two adjacent surfaces.

11. The chair of claim 10 further comprising:

(a) the top cover communicating with the bottom panel;

(b) the back portion having a back tangential plane;

(c) the seating portion having a seating tangential plane;

(d) the back tangential plane and the seating portion having a plane intersection; and (e) the plane intersection having an angle preferably in a range of about 75 degrees to about 115 degrees.

12. The chair of claim 11 further comprising the plane intersection having an angle preferably in the range of about 80 degrees to about 110 degrees.

13. The chair of claim 10 further comprising:

(a) the support panel having a thickness of up to about 5 centimeters (b) staples and screws efficiently securing the chair together;

(c) the top cover being a flexible vinyl fabric to add strength and durability to the chair while providing comfort.

14. A chair having a durable surface with an ergonomic recoverable shape comprising:

the chair having a top cover is secured to a bottom panel;

the bottom panel having a support panel secured thereover;

a foam support being situated between the support panel and the top cover;

the foam support being situated within the top cover;

the top cover being shaped by the foam support to direct a fluid flow away from a surface of the chair;

the chair including a directing means to keep the fluid from passing under the chair;

the support panel having a thickness of up to about 5 centimeters;

the directing means including a fluid directing perimeter rim on a bottom surface of the chair;

the top cover providing a seating portion and a back portion for the chair;

the foam support shaping the back portion and the seating portion of the chair;

the top cover having a bottom cover perimeter;

the bottom panel having a bottompanel perimeter;

the fluid directing perimeter rim being at or adjacent to the bottom cover perimeter and the bottom panel perimeter;

an S-curve in a portion of the top cover connecting the back portion and the seating portion of the chair;

the chair foam support having a density of about 10 grams to about 50 grams per cubic centimeter;

the foamed polymer supporting the top cover from the inside and filling the space between the bottom panel and the top cover;

the foamed polymer being at least one polymer selected from the group consisting of foamed polyurethane, and foamed polyimide;

the bottom panel being substantially centrally located in a bottom portion of the top cover;

the bottom portion of the top cover having the fluid directing perimeter rim in order for a fluid on the chair to flow down the chair and contact the fluid directing perimeter rim so that the fluid is directed away from an under portion of the chair;

the support panel having a thickness of up to about 5 centimeters;

staples and screws securing the chair together; and the top cover being a flexible vinyl fabric to add strength and durability to the chair while providing comfort.

* * * * *